United States Patent [19]

Kenan

[11] Patent Number: 4,470,153

[45] Date of Patent: Sep. 4, 1984

[54] MULTIWALL POUCH BAG WITH VENT STRIP

[75] Inventor: Ralph H. Kenan, Pensacola, Fla.

[73] Assignee: St. Regis Paper Company, West Nyack, N.Y.

[21] Appl. No.: 366,548

[22] Filed: Mar. 8, 1982

[51] Int. Cl.[3] ..... B65D 33/01

[52] U.S. Cl. ..... 383/100; 383/78; 383/107; 383/103; 493/213; 493/932; 206/439; 206/484.1

[58] Field of Search ..... 229/55, 48 R, 53; 493/213, 932; 206/439, 484.1; 383/100, 107, 78, 45, 103

[56] References Cited

U.S. PATENT DOCUMENTS

| | | | |
|---|---|---|---|
| 2,821,338 | 1/1958 | Metzger | 383/103 X |
| 3,092,249 | 6/1963 | Chapman | 206/439 |
| 3,302,859 | 2/1967 | Perry | 383/103 |
| 3,309,006 | 3/1967 | Perry et al. | 383/107 X |
| 3,394,871 | 7/1968 | Williams et al. | 229/48 R |
| 3,468,471 | 9/1969 | Linder | 206/439 |
| 3,807,626 | 4/1974 | Goodrich . | |
| 3,910,488 | 10/1975 | Goodrich | 229/55 |
| 3,927,825 | 12/1975 | Stearley | 229/55 |
| 3,958,749 | 5/1976 | Goodrich | 229/55 |
| 4,057,144 | 11/1977 | Schuster | 206/439 |
| 4,088,264 | 5/1978 | Vogt . | |

*Primary Examiner*—William T. Dixson, Jr.
*Assistant Examiner*—Bryon Gehman
*Attorney, Agent, or Firm*—Joseph M. Maguire

[57] ABSTRACT

A multiwall bag having an interior plastic pouch formed from a sealed plastic tube having a longitudinal seam comprising overlapping tube margins sealed together by two spaced seals to provide a channel, one of the tube margins being formed with openings providing communication between the interior of the tube and the channel to permit escape of air from the tube. A strip of material is disposed along the length of the channel to prevent the overlapping tube margins from adhering to each other between the spaced seals.

12 Claims, 7 Drawing Figures

Fig. 5.
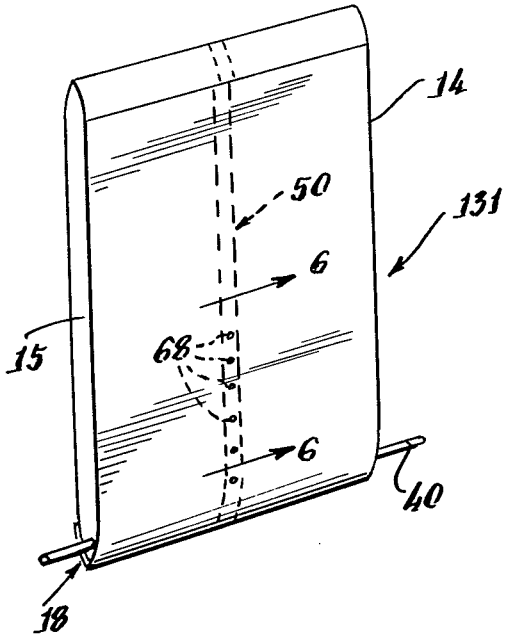
Fig. 6.
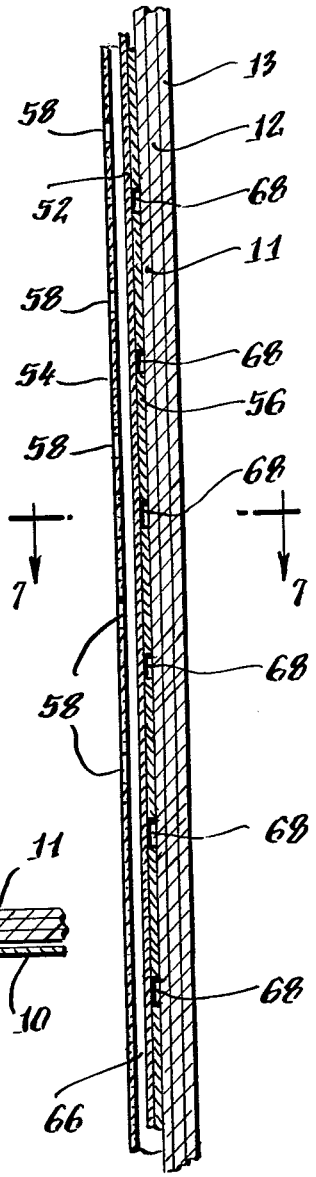
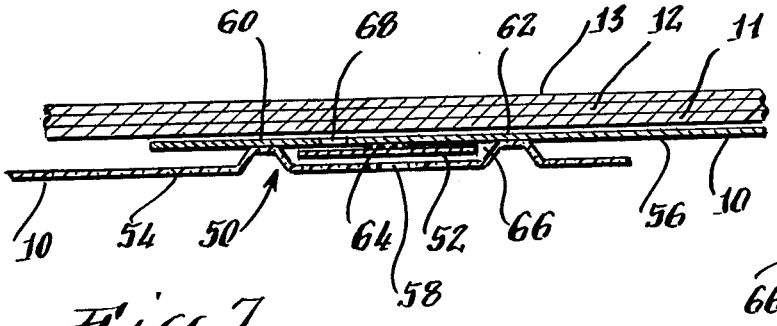
Fig. 7.

MULTIWALL POUCH BAG WITH VENT STRIP

TECHNICAL FIELD

This invention pertains to an improvement in a multiwall bag of the gusseted and so called pinch bottom type and more particularly, a multiwall pinch bottom bag constructed to allow air to escape from a sealed pouch housed inside of the multiwall bag.

PRIOR ART

Bags of this type of construction contain a plurality of plies of flexible sheet material, such as paper, laminated to one another in superimposed relation which are formed into a tube having gusseted side-walls interposed between front and back walls, one of which overlaps the other at each bag end. One overlapping end in the bag is folded over and sealed against the opposite wall to provide an open ended bag ready for filling, usually with a bulk, granular or powdery material, whereupon the opposite overlapping end is similarly folded over and sealed against the opposite wall thereby to completely seal the packaged material within the bag enclosure. Also, in such bags as heretofore produced, the innermost ply was sometimes provided with a moisture impervious plastic coating or an innermost ply of plastic material which was permanently laminated to the innermost paper ply.

All such conventional bag constructions were objectionable for the packaging of comestibles, such as dry powdered milk, eggs or the like, in that during handling and shipment the bag exteriors become highly contaminated with dust, bacteria and other contaminating substances, to the extent that it becomes extremely difficult, if not impossible to prevent contamination of the packaged material when the bag is opened to discharge the contents.

In an effort to prevent such contamination, it has become common practice to manually insert into an open ended paper bag a separate plastic pouch, and then after the pouch within the bag is filled, the pouch itself is manually tied closed at its open end and pushed down into the bag so that it does not interfere with closure of the bag itself, usually accomplished by sewing the closure. This practice is objectionable in that it requires that the bag and pouch components be separately produced and the components manually assembled, which is unduly expensive. Also the manual tying of the pouch when filled and subsequent closure of the bag proper retards the closure operations. In addition, the manual handling of the plastic pouch in the bag and pouch assembly and tying operations as well as the subsequent untying to discharge the contents, are sources of potential contamination.

Accordingly, in order to eliminate these highly objectionable features, it has been proposed to provide an innermost bag ply of a heat sealable plastic material, which is loosely adhered to a contiguous paper ply for manual detachment therefrom and which is heat sealed transversely of the bag at the closed end, the bag closure at said end being otherwise completed by folding over an overlapping wall portion of the outermost plies and sealing against the opposite wall. Also when the bag is filled with a comestible or the like, the opposite end of the plastic ply is closed by heat sealing prior to folding over and sealing the overlapping wall portions of the outermost plies at said end. The plastic ply is of such length as not to be included in the sealed bag end closures provided by the outermost plies. The bag may thus be opened in the outermost plies leaving intact the plastic ply and therein packaged contents. And since the plastic ply is only lightly adhered to the contiguous ply, the outer plies may be torn or cut away and peeled off of the plastic ply without rupture thereof for removal of a thus completely sealed and impervious plastic ply container of the packaged material. For removal of the packaged contents without contamination, the exterior of this plastic container may be sterilized and the container slit and its contents discharged under wholly sterile conditions in a sterile atmosphere. Examples of such multiwall bag constructions are completely illustrated and described in U.S. Pat. Nos. 3,807,626,; 3,910,488; and 4,088,264; whose disclosures are all incorporated herein by reference.

One further problem that has been encountered with bags of this type is that air can be entrapped within the product bulk packaged in the bag pouch such as non-fat dry milk, or air can be entrapped in the area of the pouch above the product at the time the plastic pouch is sealed. Upon stacking of the bags, any entrapped air in the pouch would be pushed against the interior sides of the pouch, rupturing the seal on the pouch and causing contamination of the pouch contents.

One solution to this problem is disclosed in U.S. Pat. No. 3,302,859, which relates to a bag having a longitudinal seam with overlapping margins secured together throughout their length, and where one of the margins has a series of vents therein to allow air to escape from the bag. The embodiments disclosed in this patent, however, have no means for preventing material in the bag from entering the space between the overlapping margins and, vice-versa, to prevent contaminants from entering the bag from its external environment, through the air vents. Further, no means are provided to prevent the walls which form the space between the margins from becoming permanently closed together when the margins are being secured at their edges, e.g. by heat sealing.

Accordingly, to allow proper stackability and to prevent rupture of the pouch seal, as much air as practicable should be allowed to freely escape from the pouch and bag, without loss of the pouch contents and without exposure of the pouch contents to contamination. This invention provides such a means of deaeration.

SUMMARY OF THE INVENTION

In accordance with the invention, air is allowed to escape along a longitudinal seam formed during the production of the inner plastic pouch. A spacer of paper or filter-type material such as filter cord is positioned along the length of the pouch between the overlapped portions of the plastic pouch forming the seam. Holes are punched or die cut in the seam area material on the inside of the seam, that is, on the side of the seam facing the product and two longitudinal beads of adhesive are used to join the pouch material to form the seam, the adhesive being positioned on opposite sides of the spacer. Air could then travel in the channel along the film overlap between the two beads of adhesives and either out another set of holes in the top portion of the overlap, or the area away from the product, or alternatively, through a heat seal closure which is rendered non-continuous in that area because of the filter material or paper vent strip incorporated into the seam seal.

BRIEF DESCRIPTION OF THE DRAWINGS

Further objects and advantages of the invention will become more apparent from the following description and claims and from the accompanying drawings, wherein:

FIG. 5 is a perspective view of an alternative embodiment of a multiwall bag constructed in accordance with the present invention;

FIG. 6 is a cross-sectional view of the bag of FIG. 5 taken substantially along the plane indicated by line 6—6 of FIG. 5;

FIG. 7 is a cross-sectional view taken substantially along the plane indicated by line 7—7 of FIG. 6.

DETAILED DESCRIPTION

Figure 1:
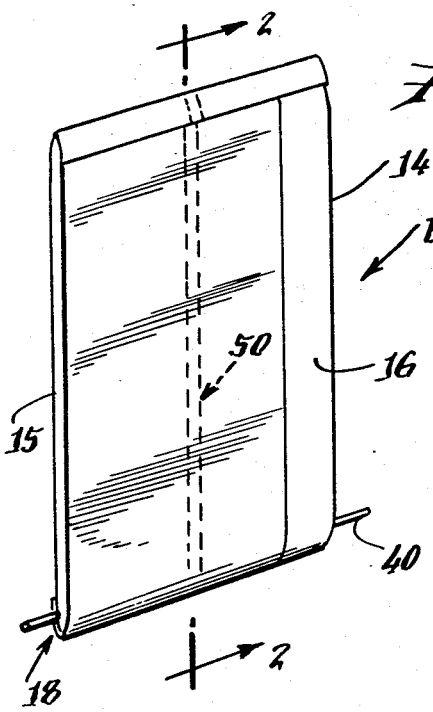
FIG. 1 is a perspective view of the multiwall bag of the present invention.

Referring now to the drawings in detail, wherein like numerals indicate like elements throughout the several views, the bag B shown therein consists essentially of front and rear walls 16 and 17, respectively, each of which includes an innermost ply 10 of a heat sealable thermoplastic material, and three outer plies 11–13 inc., made preferably of heavy kraft paper, although other suitable flexible sheet stock may be employed. The bag is gusseted along oppositely disposed sidewalls, as at 14, 15, on opposite sides of relatively wide front and rear walls 16, 17.

The bag B as manufactured, is initially open at the top and closed at the bottom with a pinch bottom closure as at 18, described in detail hereinafter. The paper plies 11–13 inc. of each wall are securely laminated to one another at the top and base of the bag, while the plastic ply 10 is only lightly adhered to the contiguous paper ply 11 at the top and base of the bag as at 19 and 20.

Figure 2:
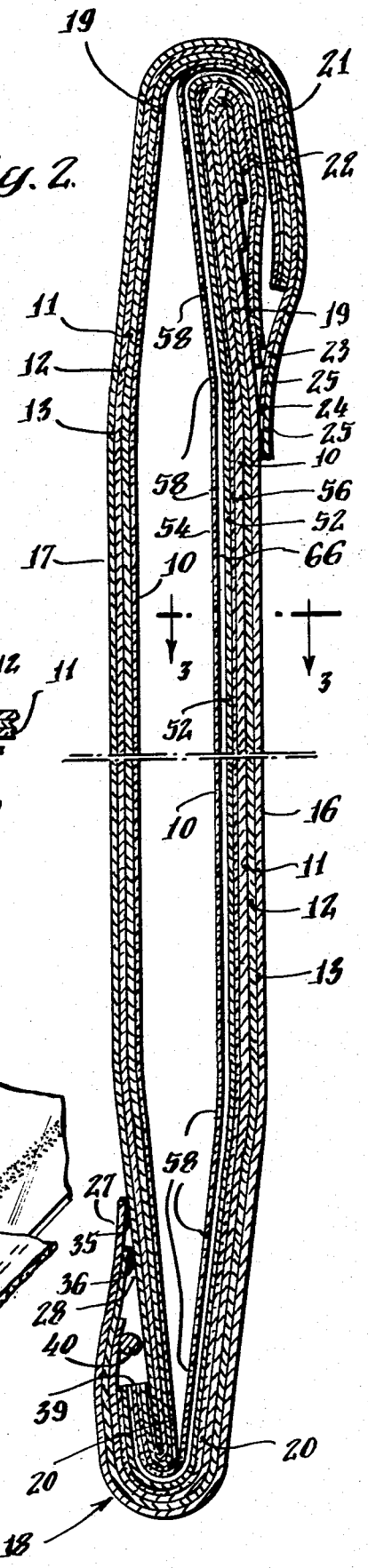
FIG. 2 is a longitudinal cross-sectional view of the bag of FIG. 1, taken substantially along the plane indicated by line 2—2 of FIG. 1.
Figure 3:
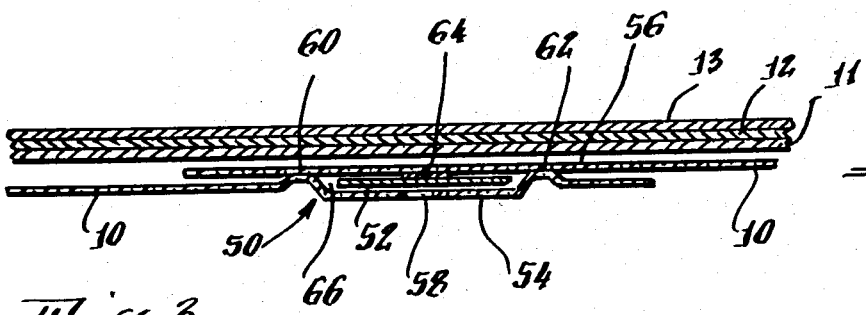
FIG. 3 is a cross-sectional view taken substantially along the plane indicated by line 3—3 of FIG. 2.
Figure 4:
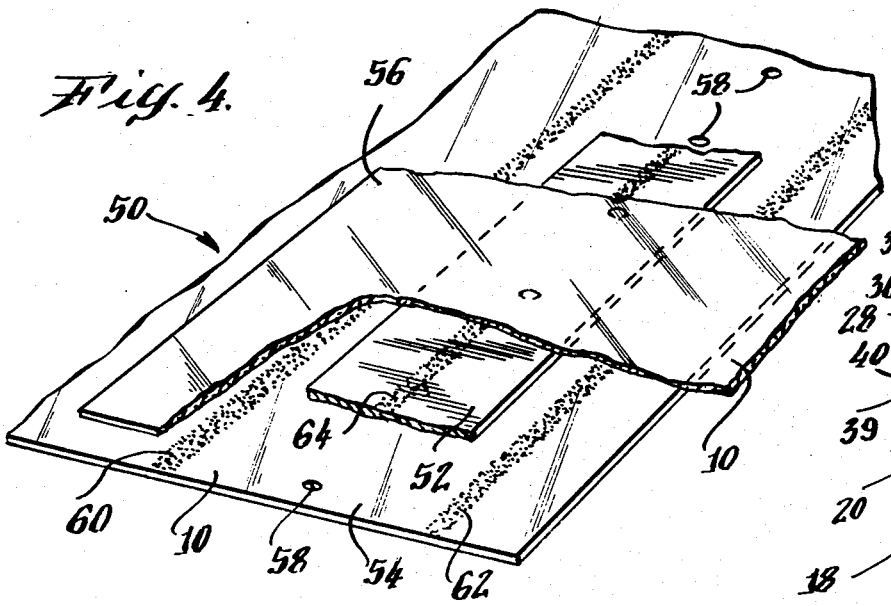
FIG. 4 is a partial perspective view, with portions broken away for purposes of illustration, of the seam area of the inner pouch bag contained within the multiwall bag of FIG. 1.

As best shown in FIG. 2, the plastic and contiguous paper plies 10, 11 respectively, are substantially flush cut in the front and rear walls and in the gussets, and the outer plies 12, 13, are substantially flush cut coincident therewith in the gussets. However, the outer plies 12, 13 are stepped successively downward in the front wall 16 with respect to plies 10, 11, as shown at 21, 22, and are stepped successively upward with respect thereto in the back wall 17, as at 23, 24. In the back wall, therefore, the outer plies 12, 13, extend beyond or overlap all plies in the gusset and front wall portions of the bag at the open top end, and thus may be folded over and sealed at spaced spots against the corresponding plies in the front wall or on the outermost ply 13 thereof, for which purpose the overlap area is coated with a thermoplastic adhesive, at spaced spots, as at 25, once the bag B is filled. This leaves the bag open to the atmosphere at spaced locations along the seal for the transmission of air from the interior of the bag B as will be made clear hereinafter.

At the bottom of the bag, the outer plies 12, 13 are correspondingly stepped with respect to the inner plies 10, 11 except in the reverse order as between the back and front walls. Closure at the base of the bag to provide the pinch bottom closure 18 is accomplished in two steps. The first step consists in applying heat and pressure between the opposite walls of the blank at the lower end, as by means of hot compression rolls or bars. This heat seals the oppositely disposed wall portions of the thermoplastic ply to each other to provide a sealed closure of the ply at the bottom of the bag. A thermoplastic adhesive is then applied to the stepped portions of plies 12, 13 as at 35, 36 and the overlapping portions 27, 28 of the outer plies 12, 13 are folded over against the opposite wall of the bag as shown in FIG. 2, and compressed between compression rolls or bars to complete the bottom closure of the bag. It will be noted with reference to FIG. 2, that in producing this closure, the outer bag plies 11, 12, 13 are looped about the lower sealed end of the thermoplastic ply 10, as at 39, so that if the bag is subsequently opened at the bottom by slitting only the outer plies 11, 12, 13 the thermoplastic ply will remain intact.

In order to assure opening the bag in this manner, a rip cord or tear string 40, is interposed as shown in FIG. 2, between Ply 11 of front wall 16 and ply 13 of rear wall 17, upon folding over and completing the bag closure in the manner above described.

Air has a tendency to be entrapped within the product bulk packaged in the thermoplastic ply 10 or the bag pouch such as non-fat dry milk during filling of the ply, or air can be entrapped in the area of the ply above the product at the time the plastic ply is sealed. Upon stacking of the bags B, any entrapped air in the ply would be pushed against the interior sides thereof, possibly rupturing the seal on the ply and causing contamination of the ply contents.

Air is allowed to escape along a longitudinal seam 50 formed during the production of the inner ply 10. A spacer of paper 52 or filter-type material such as filter cord is positioned along the length of the ply 10 between the overlapped portions 54 and 56 of the plastic ply 10 forming the seam 50. Holes 58 are punched or die cut in the same area material on the inside portion 54 of the seam 50, that is, on the side of the seam 50 facing the product and two longitudinal beads of adhesive 60, 62 are used to join the ply portions 54, 56 to form the seam 50, the adhesive being positioned on opposite sides of the paper spacer 52, which can be joined to the outer ply portion 56 by a line of adhesive 64. Air could then travel in the channel 66 along the overlap portions 54, 56 between the two beads of adhesives 62 and 60, through the heat seal closure along the width of ply 10, which is rendered non-continuous in the area of seam 50 because of the paper vent strip or filter material 52 incorporated into the same seal, and discharged to the atmosphere by way of the spaces between spots 25 of adhesive connecting ply 13 of front wall 16 to ply 12 of rear wall 17.

Alternatively, as shown in bag B′ (FIGS. 5 to 7), wherein the identical numerals are used to indicate the identical elements utilized in bag B (FIGS. 1 to 4), the air trapped within ply 10 can be transmitted from the channel 66 out a second set of holes 68 in the overlapped seam ply portion 56 to the atmosphere by way of the spaces between adhesive spots 25, the holes 68 being offset and not in registration with holes 58 in ply portion 54 to reduce the possibility of contamination of the bulk material in ply 10.

In any event, the use of a paper vent strip or a strip of a filtering medium as a spacer 52 substantially precludes material in the ply 10 from entering the seam channel 66 and vice-versa, from contaminants entering the ply 10 through openings 58. The strip 52 also avoids blockage of channel 66 by preventing opposed portions 54, 56 of the plastic seam 50 from adhereing to each other during heat sealing of the seam.

While in the preferred embodiment of the invention described above the vent strip 52 is applied to a plastic pouch inside of a multi-wall paper bag, it will be understood that the invention has application to a plastic pouch standing alone.

I claim:

1. A bag formed from a sealed plastic tube having a longitudinal seam comprising overlapping tube margins sealed together by two spaced seals providing a channel, said channel extending across at least one sealed end of said bag, one of the tube margins being formed with openings providing communication between the interior of the tube and the channel to permit escape of air from the tube, and a papery spacer strip disposed along the length of the channel preventing the overlapping tube margins from adhering to each other between the spaced seals.

2. A multiwall bag of tubular form, adapted to be sealed at opposite ends thereof, comprising opposed walls including a plurality of contiguous outer plies of paper and an innermost ply of heat sealable plastic material, said plastic ply being transversely heat sealed to form a closure over a zone adjacent each of said opposite ends, and said plastic ply having deaeration means for allowing trapped air within said sealed plastic ply to escape from the interior thereof to relieve pressure on said plastic by closures, said deaeration means including a longitudinal seam formed by overlapping spaced side edges of said plastic ply joined along spaced lines providing an unsecured channel portion therebetween through which air is adapted to be conveyed from the interior of said sealed plastic ply, said channel extending across at least one of said transversely heat sealed zones forming a closure at one end of said plastic ply, a plurality of openings in the innermost, overlapped side edge of said plastic ply forming said seam for providing communication between the interior of said sealed plastic ply and said channel, and a papery spacer strip disposed in said channel for inhibiting commodity material housed within said sealed plastic ply of said bag from entering said channel and the opposed portions of said overlapped side edges of said ply forming said channel from adhering to each other.

3. A multiwall bag in accordance with claim 2 wherein said strip is a paper strip disposed in said channel between said spaced lines of joinder.

4. A multiwall bag in accordance with claim 2 wherein said strip is a strip of a filtering medium disposed in said channel between said spaced lines of joinder.

5. A multiwall bag in accordance with claim 3 or 4 wherein said strip is secured to the outermost, overlapped side edge of said plastic ply.

6. A multiwall bag in accordance with claim 2 including a second set of a plurality of openings extending through the outermost, overlapped side edge of said plastic ply forming said seam.

7. A multiwall bag in accordance with claim 6 wherein said strip is a paper strip disposed in said channel between said spaced lines of joinder.

8. A multiwall bag in accordance with claim 7 wherein said lines of joinder are formed by lines of an adhesive.

9. A multiwall bag in accordance with claim 6 wherein said strip is a strip of filtering medium disposed in said channel between said spaced lines of joinder.

10. A multiwall bag in accordance with claim 7 or 9 wherein said strip is secured to the outermost, overlapped side edge of said plastic ply.

11. A multiwall bag in accordance with claim 2 wherein said lines of joinder are formed by lines of an adhesive.

12. The method of making a vented bag from a web of plastic material comprising forming a series of vents in one side margin of the web, placing a papery spacer strip along the length of the other side margin of the web, forming the web into a tube by bringing the side margins into overlapping relation and sealing them together by two spaced seals on opposite sides of the vents and the spacer strip to provide a channel communicating with the interior of the bag by way of the vents to permit escape of air from the tube, the spacer strip preventing the overlapping tube margins from adhering to each other between the spaced seals, and sealing one end of the tube with the channel extending thereacross.

* * * * *

UNITED STATES PATENT AND TRADEMARK OFFICE

CERTIFICATE OF CORRECTION

PATENT NO. : 4,470,153

DATED : September 4, 1984

INVENTOR(S) : Ralph H. Kenan

It is certified that error appears in the above-identified patent and that said Letters Patent is hereby corrected as shown below:

In claim 2, column 5, line 35, "by" is changed to -- ply --.

Signed and Sealed this

*Twelfth* Day of *March 1985*

[SEAL]

*Attest:*

DONALD J. QUIGG

*Attesting Officer* *Acting Commissioner of Patents and Trademarks*